US009708693B2

(12) United States Patent
Janik et al.

(10) Patent No.: US 9,708,693 B2
(45) Date of Patent: Jul. 18, 2017

(54) HIGH PHOSPHORUS ELECTROLESS NICKEL

(71) Applicant: MacDermid Acumen, Inc., Waterbury, CT (US)

(72) Inventors: Robert Janik, Pinckney, MI (US); Nicole J. Micyus, South Lyon, MI (US)

( * ) Notice: Subject to any disclaimer, the term of this patent is extended or adjusted under 35 U.S.C. 154(b) by 270 days.

(21) Appl. No.: 14/294,437

(22) Filed: Jun. 3, 2014

(65) Prior Publication Data

US 2015/0345026 A1 Dec. 3, 2015

(51) Int. Cl.

| | |
|---|---|
| ***C23C 18/36*** | (2006.01) |
| ***C23C 18/32*** | (2006.01) |
| ***C22C 19/03*** | (2006.01) |

(52) U.S. Cl.

CPC ..... *C22C 19/03* (2013.01); *C23C 18/36* (2013.01)

(58) Field of Classification Search

CPC . C23C 18/32–18/36; C23C 18/1633–18/1698; C22C 19/03

See application file for complete search history.

(56) References Cited

U.S. PATENT DOCUMENTS

| | | | |
|---|---|---|---|
| 3,887,732 | A | 6/1975 | Parker et al. |
| 5,258,061 | A | 11/1993 | Martyak et al. |
| 5,718,745 | A | 2/1998 | Itoh et al. |
| 6,020,021 | A | 2/2000 | Mallory, Jr. |
| 6,048,585 | A | 4/2000 | Martyak et al. |
| 6,800,121 | B2 | 10/2004 | Shahin |
| 2011/0192316 | A1 | 8/2011 | Chou et al. |
| 2012/0156387 | A1 | 6/2012 | Stark et al. |
| 2014/0050769 | A1 | 2/2014 | Heo et al. |

FOREIGN PATENT DOCUMENTS

| | | |
|---|---|---|
| EP | 2 671 969 | 12/2013 |
| JP | 2003-147549 | 5/2003 |
| JP | 2009-203536 | 9/2009 |
| JP | 2006/169605 | 6/2011 |
| WO | 2012/030566 | 3/2012 |
| WO | 2014/015063 | 1/2014 |

OTHER PUBLICATIONS

NIIR Board of Consultants and Engineers, The Complete Technology Book on Electroplating, Phospating, Powder Coating and Metal Finishing, pp. 551-553.

G. Mallory, "The Fundamental Aspects of Electroless Nickel Plating".

*Primary Examiner* — Lois Zheng

(74) *Attorney, Agent, or Firm* — Carmody Torrance Sandak & Hennessey LLP

(57) ABSTRACT

An electroless nickel plating bath comprising: i) a source of nickel ions; ii) an effective amount of thiourea; iii) an effective amount of saccharin; iv) a source of hypophosphite ions; v) one or more chelating agents; and vi) optionally, other additives and a method of using the same to provide a high phosphorus electroless nickel plating deposit on a substrate. The high phosphorus electroless nickel deposit is capable of passing an RCA nitric acid test, whereby the substrate with the high phosphorus nickel deposit thereon is immersed into concentrated nickel acid for 30 seconds and a deposit that does not turn black or grey is deemed to have passed the RCA nitric acid test.

14 Claims, No Drawings

HIGH PHOSPHORUS ELECTROLESS NICKEL

FIELD OF THE INVENTION

The present invention relates generally to electroless nickel phosphorus plating solutions and the production of high phosphorus electroless nickel deposits using the same.

BACKGROUND OF THE INVENTION

The electroless nickel plating industry has long been involved in developing metal coatings for various applications and various substrates. These coatings are deposited on substrates, including metallic and non-metallic substrates, to impart physical and chemical properties of a nickel alloy to the substrate. The electroless plating method typically utilizes reducing agents, such as hypophosphite or boron and is generally characterized as a controlled autocatalytic chemical reduction process for depositing the desired metal alloy on the substrate. The deposit is formed by immersing the substrate into an aqueous nickel plating solution in the presence of the reducing agent and under appropriate electroless nickel processing conditions.

Phosphorus-containing nickel alloys as produced in an electroless nickel plating process are valuable coating deposits having desirable properties such as corrosion resistance and high hardness. Electroless nickel plating employing phosphorus reducing agents such as hypophosphites provide a continuous deposit of a nickel phosphorus alloy coating on metallic or non-metallic substrates without the need for an external plating current.

Electroless nickel is often referred to as "autocatalytic" plating because the metal being applied is in solution and adheres itself to the substrate with the use of an electrical power current. Thus, one of the primary benefits of electroless deposition is that it requires no electricity for metallic deposition. Electroless plating also differs from "immersion" plating in that desired thicknesses of the deposited layer(s) can be achieved in contrast to immersion plating in which coverage with only nominal thickness may be achieved.

Electroless nickel processes are capable of depositing a reliable, repeatable nickel coating of uniform thickness on various substrates, including non-conductive or dielectric substrates such as plastics and ceramics and on metal substrates, including steel, aluminum, brass, copper and zinc. Because electroless nickel is free from flux-density and power supply issues, it is capable of providing an even deposit regardless of workpiece geometry. Thus, it is capable of effectively coating substrates with complex geometries, including sharp edges, deep recesses, internal areas, seams and threads, without resulting in excessive build up on points, corners, etc. In addition, electroless nickel coatings also demonstrate excellent corrosion protection and improved wear resistance as well as good lubricity, high hardness and good ductility.

Electroless nickel may also be used for the coating of non-conductive substrates such as plastic substrates, to render the surface of such substrates conductive and/or to change the appearance of the substrate. Furthermore, by the deposition of nickel, the material properties of the coated substrate can be improved, including corrosion resistance, hardness and wear resistance.

In electroless nickel plating baths employing hypophosphite ions as the reducing agent, the nickel deposit comprises an alloy of nickel and phosphorus with a phosphorus content of from about 2% to more than 12%. These alloys have unique properties in terms of corrosion resistance and (after heat treatment) hardness and wear resistance.

Deposits from nickel phosphorus baths are distinguished by phosphorus content, which in turn determines deposit properties. The percentage of phosphorus in the deposit is influenced by a number of factors, including, but not limited to, bath operating temperature, the operating pH, the age of the bath, concentration of hypophosphite ions, concentration of nickel ions, the phosphite ion and hypophosphite degradation product concentration as well as the total chemical composition of the plating bath including other additives.

Low phosphorus deposits typically comprise about 2-5% by weight phosphorus. Low phosphorus deposits offer improved hardness and wear resistance characteristics, high temperature resistance and increased corrosion resistance in alkaline environments. Medium phosphorus deposits typically comprise about 6-9% by weight phosphorus. Medium phosphorus deposits are bright and exhibit good hardness and wear resistance along with moderate corrosion resistance.

High phosphorus deposits typically comprise about 10-12% (or more) by weight phosphorus. High phosphorus deposits provide very high corrosion resistance and the deposits may be non-magnetic (especially if the phosphorus content is greater than about 11% by weight).

Heat treatment of the electroless nickel deposit (at temperatures of at least about 520° F.) will increase the magnetism of the deposit. Additionally, even deposits that are typically non-magnetic as plated will become magnetic when heat-treated above about 625° F. The hardness of electroless nickel coatings may also be enhanced by heat treatment and is dependent on phosphorus content and heat treatment time and temperature.

It is oftentimes desirable to introduce sulfur into the electroless nickel plating solution to improve properties of the electroless nickel phosphorus deposit. In addition, it is also desirable to produce a nickel phosphorus deposit that is capable of passing the RCA nitric acid test. The RCA nitric acid test is a quality control test that involves immersing an electroless nickel phosphorus coated coupon or part into concentration nitric acid (70% by wt.) for 30 seconds. If the coating turns black or grey during immersion it fails the test.

Deposit porosity and co-deposited contaminants such as sulfur have been found to affect the results. Thus, the inclusion of sulfur in the deposit can cause the coating to fail the RCA nitric acid test.

U.S. Pat. No. 5,718,745 to Itoh et al., the subject matter of which is herein incorporated by reference in its entirety, describes an electroless plating bath for forming black coatings comprising a nickel salt and a reducing agent and further containing a sulfur-containing compound, zinc ions and, optionally, microparticles.

U.S. Pat. No. 3,887,732 to Parker et al., the subject matter of which is herein incorporated by reference in its entirety, describes that the residual stress of a nickel-phosphorus coating deposited on a metal substrate may be controlled.

High level of phosphorus (above about 9% by weight, more preferably above about 10% by weight) and up to about 14-15% by weight are often desirable for certain industrial applications such as memory disks.

SUMMARY OF THE INVENTION

It is an object of the present invention to provide an electroless nickel phosphorus plating bath capable of producing between about 9 and about 13 percent by weight phosphorus in the plating deposit.

It is another object of the present invention to provide an electroless nickel phosphorus deposit that has little or no sulfur in the deposit.

It is still another object of the present invention to produce a high phosphorus electroless nickel deposit capable of passing the RCA nitric acid test.

It is still another object of the present invention to produce a high phosphorus electroless nickel deposit having low stress in the deposit.

To that end, in one embodiment, the present invention relates generally to an electroless nickel plating bath comprising:

a) a source of nickel ions;
b) an effective amount of thiourea;
c) an effective amount of saccharin;
d) a source of hypophosphite ions;
e) one or more chelating agents; and
f) optionally, other additives.

In another embodiment, the present invention also relates generally to a method of providing a high phosphorus electroless nickel deposit on a substrate, the method comprising the steps of:

a) preparing the substrate to accept electroless nickel thereon;
b) immersing the substrate into an electroless nickel plating bath, the electroless nickel plating bath comprising:
   i) a source of nickel ions;
   ii) an effective amount of thiourea;
   iii) an effective amount of saccharin;
   iv) a source of hypophosphite ions;
   v) one or more chelating agents; and
   vi) optionally, other additives;

wherein the high phosphorus electroless nickel deposit is capable of passing an RCA nitric acid test, in which the substrate with the high phosphorus nickel deposit thereon is immersed into concentrated nickel acid for 30 seconds and a deposit that does not turn black or grey is deemed to have passed the RCA nitric acid test.

DETAILED DESCRIPTION OF THE PREFERRED EMBODIMENTS

As described herein, the present invention relates generally to an electroless nickel plating bath comprising:

a) a source of nickel ions;
b) an effective amount of thiourea;
c) an effective amount of saccharin;
d) a source of hypophosphite ions;
e) one or more chelating agents; and
f) optionally, other additives.

The source of nickel ions can be any suitable source of soluble nickel ions, and is preferably a nickel salt selected from the group consisting of nickel bromide, nickel fluoroborate, nickel sulfonate, nickel sulfamate, nickel alkyl sulfonate, nickel sulfate, nickel chloride, nickel acetate, nickel hypophosphite and combinations of one or more of the foregoing. In one preferred embodiment, the nickel salt is nickel sulfate. The soluble source of nickel ions is present in the plating bath in an amount to preferably provide a concentration of nickel metal in the bath in the range of about 1 to about 50 g/L, more preferably about 2 to about 20 g/L, and most preferably about 5 to about 10 g/L.

Nickel ions are reduced to nickel metal in the electroless nickel plating bath by the action of chemical reducing agents which are oxidized in the process. In the case of electroless nickel-phosphorus deposits, the reducing agent typically comprises hypophosphite ions and the hypophosphite ions are preferably selected from hypophosphorus acid or a bath soluble salt thereof such as sodium hypophosphite, potassium hypophosphite and ammonium hypophosphite. The amount of reducing agent employed in the electroless nickel plating bath is at least sufficient to stoichiometrically reduce the nickel cation in the electroless nickel reaction to free nickel metal, which concentration is typically in the range of about 0.01 to about 200 g/L, more preferably between about 20 g/L and about 50 g/L. If the concentration of the reducing agent is less than about 0.01 g/L, the plating speed will be reduced and if the concentration of the reducing agent is greater than about 200 g/L, the bath may begin to decompose. In addition, if necessary, the reducing agent may be replenished during the reaction.

The one or more chelating (or complexing) agents comprise ingredients effective to prevent precipitation of the nickel compound and to provide for a moderate rate of the reaction of nickel precipitation. The complexing agent(s) are generally included in the plating solutions in amounts sufficient to complex the nickel ions present in the solution and to further solubilize the hypophosphite (or other reducing agent) degradation products formed during the plating process. The complexing agent(s) generally retard the precipitation of nickel ions from the plating solution as insoluble salts such as phosphites, by forming a more stable nickel complex with the nickel ions. Generally, the complexing agent(s) are used in the compositions at a concentration of up to about 200 g/L, preferably about 15 to about 75 g/L, and most preferably about 20 to about 40 g/L.

Useful nickel chelating agents include, for example, carboxylic acids, polyamines or sulfonic acids, or mixtures thereof, by way of example and not limitation. Useful carboxylic acids include the mono-, di-, tri-, and tetracarboxylic acids which may be substituted with various substituent moieties such as hydroxy or amino groups. The acids may be introduced into the plating solutions as their sodium, potassium or ammonium, salts. Some complexing agents such as acetic acid, for example, may also act as a buffering agent, and the appropriate concentration of such additive components can be optimized for any plating solution after consideration of their dual functionality.

Examples of carboxylic acids which are useful as the nickel complexing agent the solutions of the present invention include: monocarboxylic acids such as acetic acid, glycolic acid, glycine, alanine, lactic acid; dicarboxylic acids such as succinic acid, aspartic acid, malic acid, malonic acid, tartaric acid; tricarboxylic acids such as citric acid; and tetracarboxylic acids such as ethylene diamine tetra acetic acid (EDTA), which may be used alone or in combination with each other.

The source of thiourea may comprise thiourea or a derivative of thiourea. The concentration of thiourea in the plating bath may range from 0.1 to 5 mg/L, more preferably a concentration of between about 0.5 to 3 mg/L, and most preferably at about 1 to about 2 mg/L.

The source of saccharin may comprise saccharin or a salt of saccharin, such as a sodium salt. The concentration of saccharin in the plating bath may range from about 0.1 mg/L to about 5 g/L, more preferably in the range of about 50 mg/L to about 3 g/L, and most preferably in the range of about 100 mg/L to about 300 mg/L.

In addition, the inventors have found that good results can be obtained by using a combination of saccharin and thiourea mixed with nickel sulfate to produce a nickel-phosphorus deposit that is capable of passing the RCA nitric acid test. The combination of thiourea and saccharin in the electroless nickel plating bath, as described herein, also produces a faster rate deposition, a brighter deposit and reduced stress in the deposit.

In addition, the electroless nickel plating bath may also contain other additives, if desired, including, for example buffers, wetting agents, accelerators, corrosion inhibitors, etc. as is generally well known in the art. For example, the plating solutions described herein may employ one or more wetting agents of any of the various types hereto for known which are soluble and compatible with the other bath constituents. In one embodiment, the use of such wetting agents prevents or hinders pitting of the nickel alloy deposit, and the wetting agents can be employed in amounts up to about 1 g/l.

In another embodiment, the present invention relates generally to a method of providing a high phosphorus electroless nickel deposit on a substrate, the method comprising the steps of:

a) preparing the substrate to accept electroless nickel thereon;
b) immersing the substrate into an electroless nickel plating bath, the electroless nickel plating bath comprising:
   i) a source of nickel ions;
   ii) an effective amount of thiourea;
   iii) an effective amount of saccharin;
   iv) a source of hypophosphite ions;
   v) one or more chelating agents; and
   vi) optionally, other additives;

wherein the high phosphorus electroless nickel deposit is capable of passing an RCA nitric acid test, whereby the substrate with the high phosphorus nickel deposit thereon is immersed into concentrated nickel acid for 30 seconds and a deposit that does not turn black or grey is deemed to have passed the RCA nitric acid test.

The nitric acid test is actually a test of passivity and was originally developed by the RCA Labs in New Jersey in the 1960's as a quality control test for incoming electronic components. The standard nitric acid test is an immersion of a coated coupon or part into concentrated nitric acid (70 percent by weight concentration) for 30 seconds. If the costing turns black or grey during the immersion, it fails the test.

The substrate may be selected from the group consisting of non-conductive or dielectric substrates such as plastics and ceramics and metal substrates, including steel, aluminum, brass, copper and zinc.

The step of preparing the substrate to accept nickel plating thereon typically comprises cleaning or pre-treating the surface of the substrate prior to metal deposition prior to metal deposition and the type of cleaning or pre-treating depends on the substrate material being plated. For example, copper or copper alloy surfaces may be treated with an etch cleaning method which is typically carried out in oxidizing, acidic solutions such as a solution of sulfuric acid and hydrogen peroxide. Aluminum and aluminum alloy surfaces may be treated using various zincation treatments.

The inventors of the present invention have obtained good results by using nickel sulfate as the source of nickel ions. In addition, when the thiourea is allowed to pre-mix with the nickel sulfate prior to their combination with the other bath ingredients, in particular prior to the addition of the saccharin, sulfur co-deposition is further inhibited, resulting in good results in passing the RCA nitric acid test. Thus it is best to mix the source of nickel ions, the thiourea and water together, and allowing them to react, before adding the other plating bath components, especially before adding the saccharin if it is used. For example, the inventors have found that mixing an amount of 6 to about 150 g/L of nickel sulfate with about 10 to about 50 mg/L of thiourea for a period time, and then diluting the mixture to the amount described above for the individual concentrations of nickel sulfate and thiourea, prior to combining the nickel sulfate and thiourea with saccharin produces an electroless nickel phosphorus deposit having the desired properties of low stress and high gloss and that passes the RCA nitric acid test.

The use of thiourea and saccharin in the electroless nickel phosphorus plating bath as described herein also results in additional positive effects.

For example, the use of the electroless nickel phosphorus plating bath described herein produces a faster rate deposition of at least 0.5 mil/hour, preferably at least 0.8 mil/hour and most preferably at least 1 mil/hour as compared with high phosphorus electroless nickel plating baths of the prior art. The is important because plating rate is a critical process characteristic and in many cases determines the commercial viability of a particular chemistry.

In addition the novel electroless nickel phosphorus plating bath described herein also produces a brighter deposit that is comparable to a bright mid-level phosphorus electroless nickel deposit. For example, the high phosphorus nickel deposit may have gloss readings of at least 110 GU, more preferably at least 115 GU, and most preferably at least 125 GU.

The Gloss Units (GU) value of the deposited nickel layer is measured by a Statistical Glossmeter (available from Elcometer, Inc., Rochester Hills, Mich.). Gloss is measured by directing a constant intensity light beam at an angle to the test surface and monitoring the reflected light at the same angle. Different gloss levels require different angles. The gloss meter measures the amount of light reflected back at either a 20 degree or a 60 degree angle. The gloss meter can be used in accordance with national and international standards, AS 1580-602.2, ASTM C 584, ASTM D 523, ASTM D 1455, and BS DIN EN ISO 2813. In this instance, we focused on ASTM D 523 standard. The higher the gloss number, the brighter the deposit.

Finally, the introduction of thiourea in a high phosphorus electroless nickel bath has also been found to reduce the stress in the deposit. The inventor of the present invention found that the stress remained compressive after 5 metal turnovers (MTO's).

The electroless nickel phosphorus bath described herein is capable of produces a deposit having between 9 and 13% by weight phosphorus in the plating deposit.

The electroless plating deposition rate is further controlled by selecting the proper temperature, pH and metal ion/reducer concentrations. Complexing ions may also be used as catalyst inhibitors to reduce the potential for spontaneous decomposition of the electroless nickel plating bath.

The aqueous electroless nickel plating baths of the present invention can be operated over a broad pH range such as from about 4 to about 10. For an acidic bath, the pH can generally range from about 4 to about 7. In one embodiment, the pH of the solution is from about 4 to about 6. For an alkaline bath, the pH can range from about 7 to about 10, or from about 8 to about 9. Since the plating solution has a tendency to become more acidic during its operation due to the formation of hydrogen ions, the pH may be periodically or continuously adjusted by adding bath-soluble and bath-compatible alkaline substances such as sodium, potassium or ammonium hydroxides, carbonates and bicarbonates. The stability of the operating pH of the plating solutions of the present invention can be improved by the addition of various buffer compounds such as acetic acid, propionic acid, boric acid, or the like, in amounts up to about 30 g/L with amounts of from about 2 to about 10 g/L being typical. As noted above, some of the buffering compounds such as acetic acid and propionoic acid may also function as complexing agents.

The substrate to be plated is contacted with the plating solution at a temperature of about 35° C. up to about the boiling point of the solution. Acidic electroless nickel plating baths are typically operated at a temperature in the range of about 60 to about 100° C., more preferably about 70 to about 90° C., while alkaline electroless nickel plating baths are operated within similar but slightly lower temperatures than the acidic electroless nickel plating baths.

The aqueous electroless nickel plating bath may be contacted with the substrate being plated for a sufficient period of time to deposit the desired thickness of the nickel-phosphorus alloy thereon. For example, a contact time can range from as little as about 1 minute to several hours, or even longer. A plating deposit of about 0.1 to about 2.0 mils is a desirable thickness for many commercial applications. If wear resistance is desired, thicker deposits can be applied up to about 5 mils or more.

During deposition of the nickel phosphorus alloy, mild agitation may be utilized, which may be accomplished by mild air agitation, mechanical agitation, bath circulation by pumping, rotation of a barrel for barrel plating, and other similar means. In addition, the plating solution may also be subjected to periodic or continuous filtration treatment to reduce the level of various contaminants therein. Replenishment of the bath constituents may also be performed, on a periodic or continuous basis, to maintain the concentration of the bath constituents, including nickel ions and hypophosphite ions, as well as the pH level, within the desired limits.

It should also be understood that the following claims are intended to cover all of the generic and specific features of the invention described herein and all statements of the scope of the invention that as a matter of language might fall there between.

What is claimed is:

1. A method of providing a high phosphorus electroless nickel plating deposit on a substrate, the method comprising the steps of:

a) preparing the substrate to accept electroless nickel thereon;

b) immersing the substrate into an electroless nickel plating bath, wherein the electroless nickel plating bath is prepared by:

i) premixing a source of nickel ions with thiourea for a period of time to allow the source of nickel ions and the thiourea to react; and ii) diluting the premixture with water; and thereafter ii) adding the following ingredients to the reacted premixture:

(a) an effective amount of saccharin;

(b) a source of hypophosphite ions;

(c) one or more chelating agents; and (d) optionally, other additives;

wherein the high phosphorus electroless nickel deposit is capable of passing an RCA nitric acid test in which the substrate with the high phosphorus nickel deposit thereon is immersed into concentrated nitric acid for 30 seconds and a deposit that does not turn black or grey is deemed to have passed the RCA nitric acid test.

2. The method according to claim 1, wherein the source of nickel ions is selected from the group consisting of nickel bromide, nickel fluorob orate, nickel sulfonate, nickel sulfamate, nickel alkyl sulfonate, nickel sulfate, nickel chloride, nickel acetate, nickel hypophosphite and combinations of one or more of the foregoing.

3. The method according to claim 2, wherein the source of nickel ions is nickel sulfate.

4. The method according to claim 1, wherein the source of hypophosphite ions is selected from the group consisting of hypophosphorus acid, sodium hypophosphite, potassium hypophosphite, ammonium hypophosphite and combinations of one or more of the foregoing.

5. The method according to claim 1, wherein the soluble source of nickel ions is present in the electroless nickel plating bath in an amount to provide a concentration of nickel metal in the bath in the range of about 1 to about 50 g/L.

6. The method according to claim 5, wherein the soluble source of nickel ions is present in the electroless nickel plating bath in an amount to provide a concentration of nickel metal in the bath in the range of about 5 to about 10 g/L.

7. The method according to claim 1, wherein the source of hypophosphite ions is present in the electroless nickel plating bath at a concentration in the range of about 0.01 to about 200 g/L.

8. The method according to claim 1, wherein the thiourea is present in the electroless nickel plating bath at a concentration in the range of about 0.5 to about 3.0 mg/L.

9. The method according to claim 8, wherein the thiourea is present in the electroless nickel plating bath at a concentration in the range of about 1.0 to about 2.0 mg/L.

10. The method according to claim 1, wherein the saccharin is present in the electroless nickel plating bath at a concentration in the range of about 0.1 mg/L to about 5.0 g/L.

11. The method according to claim 10, wherein the saccharin is present in the electroless nickel plating bath at a concentration in the range of about 100 mg/L to about 200 mg/L.

12. The method according to claim 1, wherein the electroless nickel plating bath comprises one or more additives, wherein the one or more additives are selected from the group consisting of buffers, wetting agents, accelerators, stabilizers and corrosion inhibitors.

13. The method according to claim 1, wherein the high phosphorus electroless nickel deposit contains between about 9 and about 13 percent by weight phosphorus in the deposit.

14. The method according to claim 1, wherein the pH of electroless nickel plating bath is in the range of about 4 to about 10.

* * * * *